US006508550B1

(12) United States Patent
Eastlund et al.

(10) Patent No.: US 6,508,550 B1
(45) Date of Patent: Jan. 21, 2003

(54) MICROWAVE ENERGY INK DRYING METHOD

(75) Inventors: Bernard John Eastlund, San Diego, CA (US); Donald Emmett Spann, San Diego, CA (US); Dheya Mortada Alfekri, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/579,856

(22) Filed: May 25, 2000

(51) Int. Cl.[7] ..... B41J 2/01; H05B 6/78
(52) U.S. Cl. ..... 347/102; 219/693
(58) Field of Search ..... 347/102

(56) References Cited

U.S. PATENT DOCUMENTS

| | | | | |
|---|---|---|---|---|
| 3,705,283 A | | 12/1972 | Sayer, Jr. | 219/10.55 |
| 3,851,132 A | | 11/1974 | VanKoughnett | 219/10.55 A |
| 3,999,026 A | | 12/1976 | Boling | 219/10.55 A |
| 4,160,144 A | | 7/1979 | Kashyap et al. | 219/10.55 A |
| 4,234,775 A | | 11/1980 | Wolfberg et al. | 219/10.55 A |
| 4,392,039 A | | 7/1983 | Risman | 219/10.55 A |
| 4,476,363 A | | 10/1984 | Berggren et al. | 219/10.55 A |
| 4,482,239 A | | 11/1984 | Hosono et al. | 355/3 FU |
| 4,625,088 A | | 11/1986 | Gics | 219/10.55 A |
| 5,041,846 A | * | 8/1991 | Vincent et al. | 346/25 |
| 5,220,346 A | | 6/1993 | Carreira et al. | 347/102 |
| 5,278,375 A | | 1/1994 | Berteaud et al. | 219/693 |
| 5,349,905 A | | 9/1994 | Taylor et al. | 101/488 |
| 5,371,531 A | | 12/1994 | Rezanka et al. | 347/43 |
| 5,423,260 A | | 6/1995 | Goldberg et al. | 101/424.1 |
| 5,536,921 A | | 7/1996 | Hedrick et al. | 219/693 |
| 5,563,644 A | | 10/1996 | Isganitis et al. | 347/102 |
| 5,566,344 A | | 10/1996 | Hall et al. | 345/800 |
| 5,631,685 A | | 5/1997 | Gooray et al. | 347/102 |
| 5,709,737 A | | 1/1998 | Malhotra et al. | 106/31.43 |
| 5,712,672 A | | 1/1998 | Gooray et al. | 347/102 |
| 5,764,263 A | | 6/1998 | Lin | 347/101 |
| 5,814,138 A | | 9/1998 | Fague | 106/31.43 |
| 5,853,469 A | | 12/1998 | Colt et al. | 106/31.49 |
| 6,020,580 A | | 2/2000 | Lewis et al. | 219/696 |
| 6,022,104 A | | 2/2000 | Lin et al. | 347/102 |
| 6,208,903 B1 | * | 3/2001 | Richards et al. | 607/101 |
| 6,231,176 B1 | * | 5/2001 | Peter | 347/102 |

FOREIGN PATENT DOCUMENTS

| | | | | |
|---|---|---|---|---|
| EP | 0 559 324 B1 | | 10/1995 | C09D/11/00 |
| EP | 0 555 968 B1 | | 9/1997 | C09D/11/00 |
| JP | 07314661 A | * | 12/1995 | B41J/2/01 |
| JP | 7-314661 | | 12/1995 | B41J/2/01 |

* cited by examiner

*Primary Examiner*—Hai Pham
*Assistant Examiner*—Alfred E Dudding
(74) *Attorney, Agent, or Firm*—Milton S. Sales; Thomas R. Arno

(57) ABSTRACT

Methods of drying ink using microwaves includes heating deposited ink droplets by passing a microwave applicator over them. In another embodiment, a swath of ink droplets is deposited with a plurality of sequential passes of an ink jet print head, and the deposited drops are dried between passes.

8 Claims, 12 Drawing Sheets

MICROWAVE ENERGY INK DRYING METHOD

CROSS REFERENCE TO RELATED APPLICATIONS

This application is related to the co-pending U.S. patent applications Ser. Nos. 09/580511, and 09/580,512, entitled "Microwave Energy Ink Drying System" and "Microwave Applicator for Drying Sheet Material" respectively, each of which was filed on even date herewith.

BACKGROUND OF THE INVENTION

1. Field of the Invention

The invention relates to printing. Specifically, the invention relates to drying ink with microwave energy during ink jet printing.

2. Description of the Related Art

In color ink jet printing, a relatively large quantity of ink is deposited onto the print media in a relatively short period of time. Often, there is a significant time period between the completion of a portion of an image and ink drying in that portion. In some cases, a printed image may be ruined by being rolled onto a take up reel on the printer after the image is printed but before the ink is dry. This is an especially apparent problem in humid environments, where ink drying times are considerably extended.

Furthermore, in multi-pass ink jet printing, the print head is passed over the same part of the media several times, with a portion of the required droplets deposited with each pass. In these types of print operations, quality is improved if the ink deposited in the previous pass is sufficiently dry before the print head is passed over the same part of the media a subsequent time.

To help alleviate problems associated with slow ink drying rates, various methods of drying the ink during or after printing have been developed. Some of these methods involve heating various printer components with infrared radiation or by directing heated air onto the media. These methods are inefficient at coupling heat to the printed media. In addition, water based ink can be heated by microwaves and microwave drying systems to heat and dry the deposited ink have been designed. These systems operate at about 2.45 GHz, an allowed industrial band. One such system is described in U.S. Pat. No. 5,220,346 to Carriera et al. In this system, the media is fed through a stationary microwave dryer after the ink is deposited. The dryer essentially comprises a waveguide with a magnetron and tuner coupled to one end. At least some of the microwaves in the waveguide are absorbed by the ink as the media passes through, thereby heating and drying the ink.

This type of system suffers from various difficulties. The first is that with 600 watts applied, the resultant electric fields are only about $3\times10^4$ volts/meter. A second is the fact that different portions of the cavity have different average electric field intensities, and so the drying is uneven across the image. Furthermore, even if a constant field intensity across the image were to be produced, different ink densities on different image portions will also cause uneven drying.

Image quality defects are also associated with the relatively large amount of liquid deposited on the media. For example, heavy liquid deposition can cause image defects such as color bleed, coalescence and paper deformation known as cockle. It is impossible to control coalescence with U.S. Pat. No. 5,631,685 because the print media is not dried until after the print media leaves the printer.

Additional examples of microwave drying apparatus include U.S. Pat. No. 5,631,685 awarded to Arthur Gooray. The printer described in this patent passes ink jet printed sheets through multiple applicator sections to dry the ink with a dryer similar to the low electric field apparatus described in U.S. Pat. No. 5,220,346 assigned to Carriera et al. This stationary microwave drier is bulky and still requires the sheet to leave the printer for drying. Thus, while a goal is to control cockle, the delay between printing and drying in the stationary microwave applicator makes it impossible to completely control cockle.

As another example, U.S. Pat. No. 4,234,775 awarded to Wolfberg and Harper describes a system wherein the electric field strength for web or sheet drying is enhanced by creating resonant zones of standing waves in a waveguide, then using multiple waveguides with ¼λ offsets to achieve uniformity of drying. However, unevenness in drying still results and the device is large and bulky.

Thus, the state of the art of microwave drying for ink jet printers and for web, sheet or film drying in general is to utilize low electric field applicators that are bulky or to utilize higher electric field, resonant devices that use a phase shifting or offset geometry in an attempt to achieve an average uniformity.

SUMMARY OF THE INVENTION

Methods of ink jet printing are provided. In one embodiment, a method of drying ink during or after an ink jet printing process comprises passing a microwave energy applicator over deposited ink droplets so as to heat the deposited ink droplets. In another embodiment, a method of ink jet printing comprises depositing a swath of ink droplets using a plurality of sequential passes of at least one ink jet print head, and drying ink droplets deposited during at least one of the sequential passes with microwave radiation prior to performing a subsequent pass.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
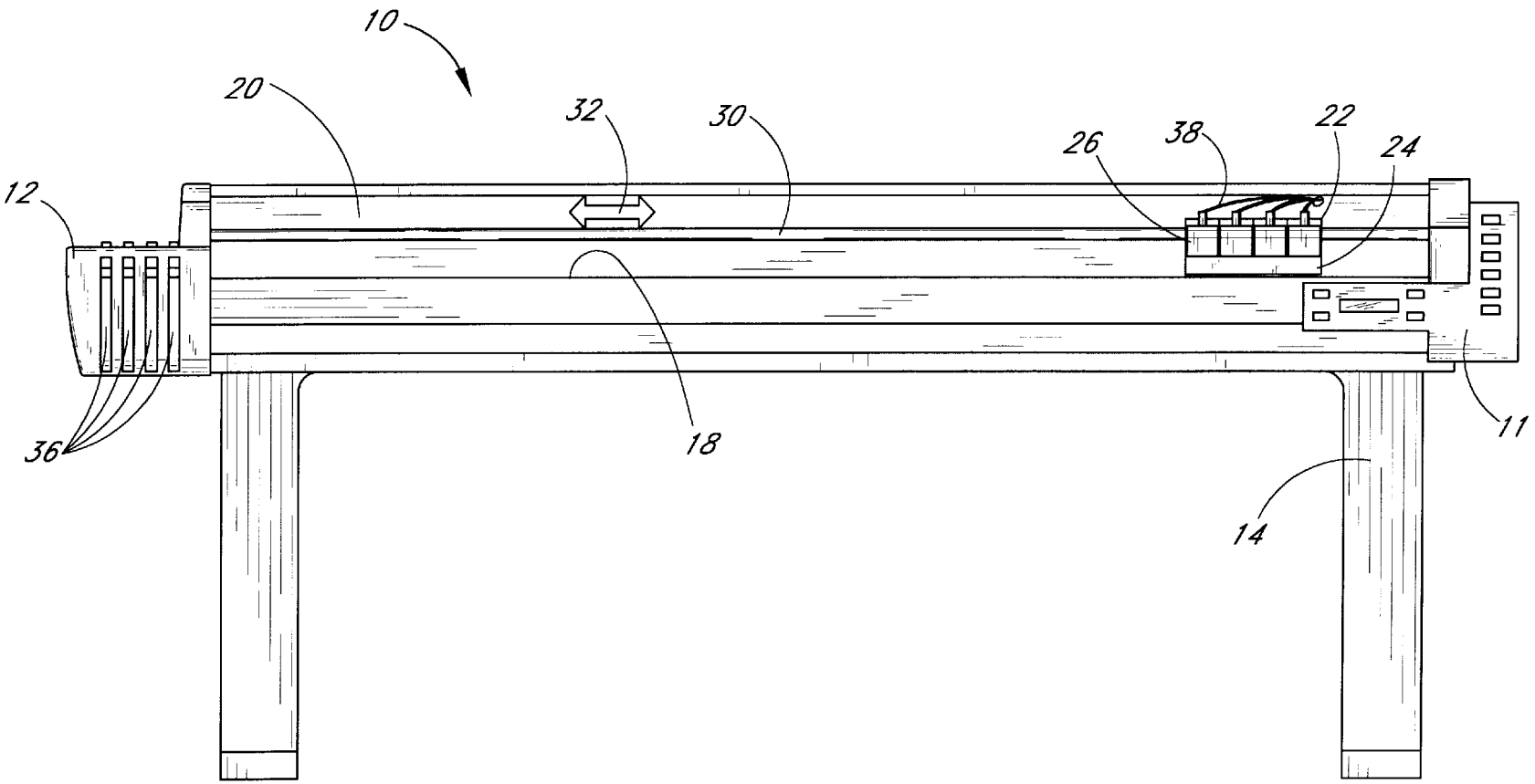
FIG. 1 is a front view of a floor standing ink jet printer.

Referring to FIG. 1, one specific embodiment of a large format ink jet printer 10 includes left and right side housings 11,12, and is supported by a pair of legs 14. The right housing 11, shown in FIG. 1 with a display and keypad for operator input and control, encloses various electrical and mechanical components related to the operation of the printer device, but not directly pertinent to the present invention. The left housing 12 encloses ink reservoirs 36 which feed ink to the ink-jet cartridges 26 via plastic conduits 38, which run between each ink-jet cartridge 26 and each ink reservoir 36. In some printer embodiments, no separate ink reservoirs 36 or tubing 38 is provided, and printing is performed with ink reservoirs integral to the cartridges.

Either a roll of continuous print media (not shown) is mounted to a roller on the rear of the printer 10 to enable a continuous supply of paper to be provided to the printer 10 or individual sheets of paper (not shown) are fed into the printer 10. A platen 18 forms a horizontal surface which supports the print media, and printing is performed by select deposition of ink droplets onto the paper. During operation, a continuous supply of paper is guided from the roll of paper mounted to the rear of the printer 10 across the platen 18 by a plurality of upper rollers (not shown) which are spaced along the platen 18. In an alternate embodiment, single sheets of paper or other print media are guided across the platen 18 by the rollers (not shown). A support structure 20 is suspended above the platen 18 and spans its length with sufficient clearance between the platen 18 and the support structure to enable a sheet of paper or other print media which is to be printed on to pass between the platen 18 and the support structure 20.

The support structure 20 supports a print carriage 22 above the platen 18. The print carriage 22 includes a plurality of ink-jet cartridge holders 24, each with a replaceable ink-jet cartridge 26 mounted therein. In a preferred embodiment, four print cartridges 26 are mounted in the holders 24 on the print carriage 22, although it is contemplated that any number ink-jet cartridges 26 may be provided. The support structure 20 generally comprises a guide rod 30 positioned parallel to the platen 18. The print carriage 22 preferably comprises split sleeves which slidably engage the guide rod 30 to enable motion of the print carriage along the guide rod 30 to define a linear printing path, as shown by the bidirectional arrow 32, along which the print carriage 22 moves. A motor and a drive belt mechanism (not shown) are used to drive the print carriage 22 along the guide rod 30.

During printing, the carriage 24 passes back and forth over the media. During each pass, the ink jet cartridges 26 deposit a swath of ink having a width approximately equal to the width of the ink jet nozzle array of the jet plate on the bottom of the cartridge. After each pass, the media is incremented, and the carriage is passed back over the media to print the next swath. Depending on the printing mode, the ink jet cartridges could print during passes in only one or both directions. Furthermore, in multi-pass print modes, the ink jet cartridges may pass over the same location of the media more than once. These aspects of ink jet printers are well known and conventional, and will thus not be explained in further detail herein.

Figure 2:
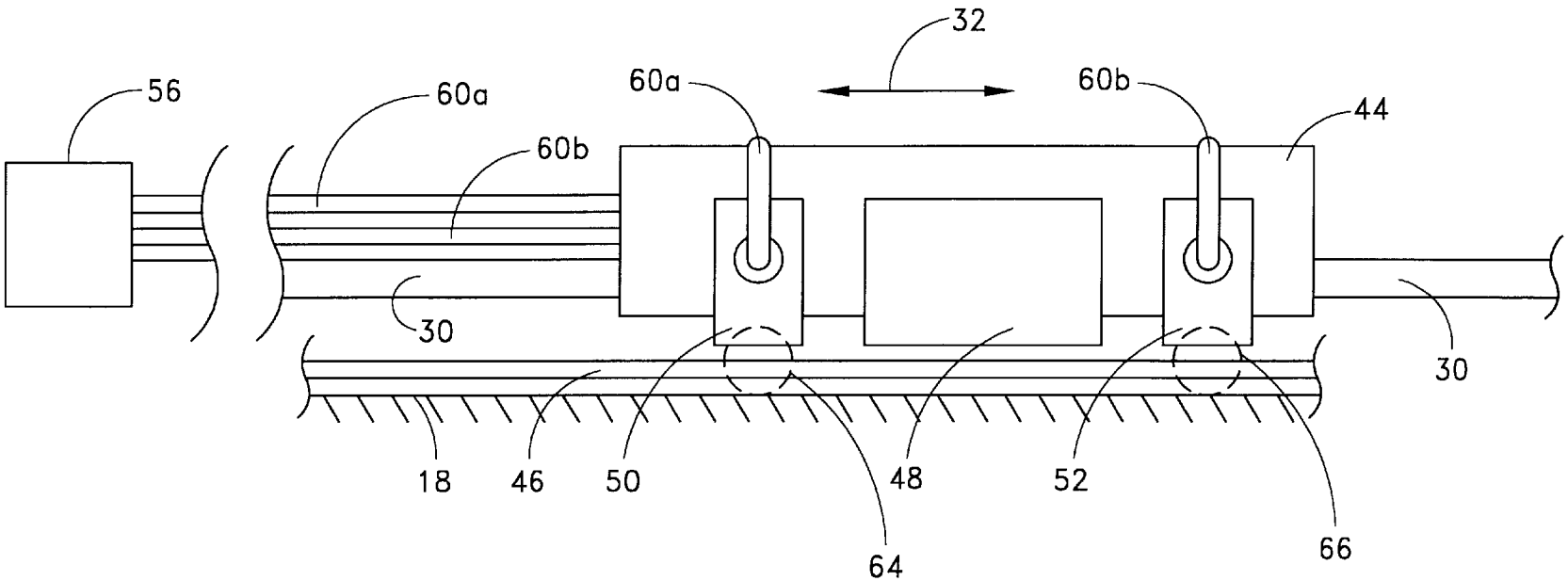
FIG. 2 is a front view of a movable print carriage in an ink jet printer in accordance with one embodiment of the invention.

In FIG. 2, an ink jet printer incorporating a movable print carriage 44 constructed in accordance with one embodiment of the invention is shown. As described above with reference to FIG. 1, the print carriage 44 is mounted on a guide rod 30 and moves back and forth in the direction of arrows 32 over a platen 18. Between the platen 18 and the carriage 44 is the media 46 being printed. The carriage mounts one or more ink applicators 48, which, for example, may comprise the four ink jet cartridges illustrated in FIG. 1, although any type of ink applicator device or method may be used in conjunction with the invention.

Also attached to the carriage 44 are two microwave energy applicators 50, 52. In the embodiment of FIG. 2, the microwave energy applicators 50, 52 are provided on opposite sides of the ink applicator 48. The microwave energy applicators 50, 52 are coupled to a microwave energy source 56, which may be mounted within one or both of the end housings (FIG. 1). The microwave energy source 56 may, for example, be a magnetron of conventional design having an output center frequency at approximately 2.45 GHz. The microwave energy source 56 may also advantageously include a means for phase shifting the microwaves to optimize coupling of the microwave applicator to the print media such as a three-stub tuner. The design and manufacture of magnetrons having suitable power outputs and center frequencies is well known, and a wide variety are currently mass produced for the microwave oven market. Alternatively, the microwave energy source 56 may be mounted on the carriage 44, rather than in an end housing. In this embodiment, a DC power supply may be provided in one or both of the end housings to supply power to a carriage mounted microwave energy source.

The microwave energy source 56 is connected to the microwave applicators with commercially available coaxial cables 60*a*, 60*b* having a construction suitable for microwave transmission. It will be appreciated that the microwave energy source 56 may comprise a single magnetron or a plurality of magnetrons. In one embodiment, each microwave applicator 50, 52 is separately coupled to a dedicated magnetron. In another embodiment, a single magnetron is connected to both microwave applicators 50, 52 via a splitter mounted in the printer housing or on the print carriage 44. As will be explained further below, each microwave energy applicator 50, 52 generates a region 64, 66 of microwave frequency oscillating electric fields in and through the media 46. These electric fields heat the media 46 and the ink deposited thereon, thereby increasing the ink drying rate dramatically.

In this embodiment, when the carriage 44 is depositing a swath of ink droplets as it moves leftward in FIG. 2, the microwave applicator 52 on the right of the ink applicator passes over the droplets just deposited by the ink applicator. As the microwave applicator 52 passes over the droplets, absorption of the microwave energy by the ink heats and dries the deposited droplets. Similarly, when the carriage 44 is moving rightward in FIG. 2, the microwave applicator 50 on the left is passing over and drying the just deposited ink droplets. In both directions of printing, the microwave applicator which is leading the ink applicator across the media may either be turned off, may be used to heat the media prior to printing, or may complete the drying of ink deposited on a previous pass, thereby further enhancing the ink drying process. The two microwave applicator embodiment shown in FIG. 2 is advantageous in printers which print bidirectionally, which the vast majority of high quality color ink jet printers do. Of course, if the printer only deposits ink when the carriage is moving in one of the two directions across the media, only one microwave applicator may be necessary. In this embodiment, the microwave applicator would be positioned relative to the ink applicator 48 such that the microwave applicator trails the ink applicator across the media as the ink applicator deposits droplets of ink. Even during unidirectional printing, however, it may be useful to pre-heat the media or complete the drying process with a second leading applicator as described above with respect to the bidirectional printer embodiment. Alternatively, both applicators can be simultaneously heating to modulate the drying process. For example, banding would be minimized with this invention.

Figure 3:
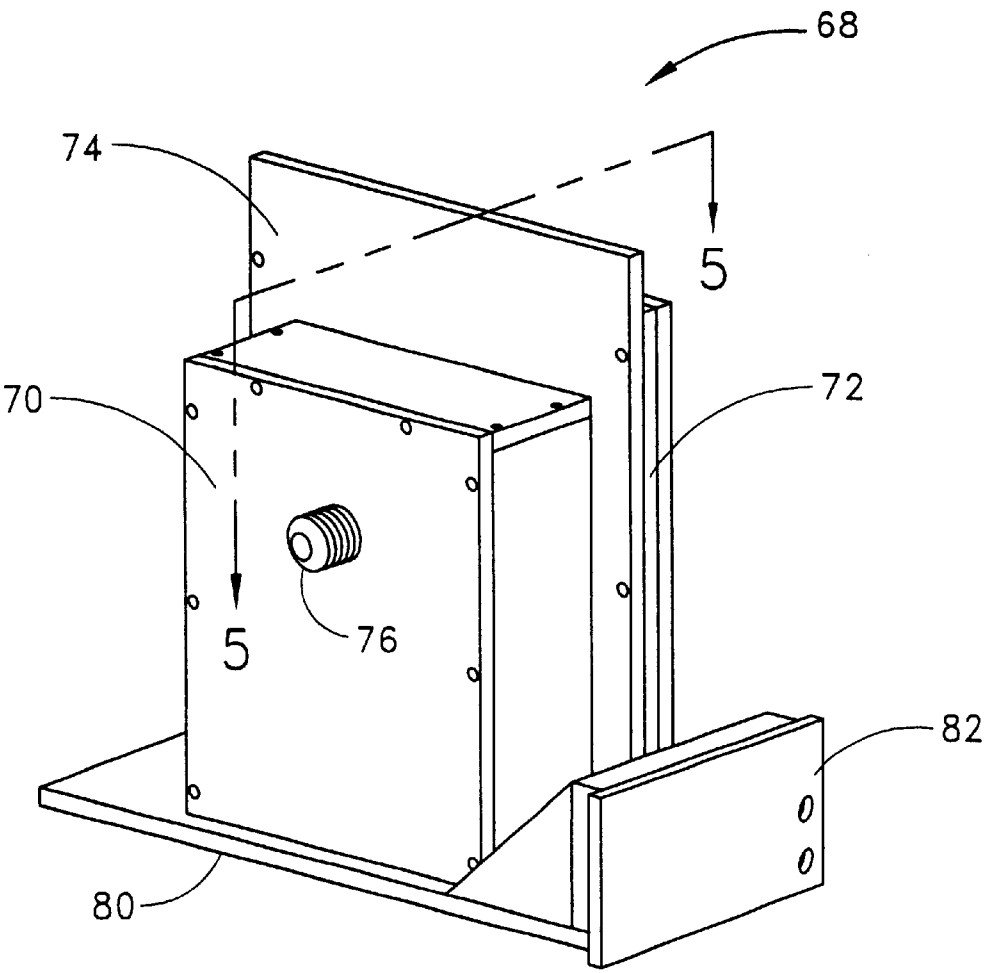
FIG. 3 is a perspective view of a microwave applicator suitable for mounting on the print carriage of FIG. 2.

FIG. 3 is a perspective view of a microwave applicator according to one embodiment of the invention which is suitable for mounting on the movable print carriage 44 illustrated in FIG. 2. This embodiment of microwave applicator 68 comprises a first chamber 70 and a second chamber 72. The first chamber 70 and the second chamber 72 are separated by a central plate 74. The first chamber 70 is a wave launching cavity and is provided with a coupler 76 for the coaxial cable which feeds the microwave energy to the applicator 68. The second chamber 72 is an impedance matching cavity that reflects microwave energy back to the wave launching cavity 70. When the impedance of the second chamber 72 is matched to the source, microwave absorption by the ink is maximized, and the total energy reflected back to the microwave energy source is minimized. A bottom plate 80 is also provided that forms a slot antenna on the bottom surface of the applicator 68 and which provides a path for transfer of microwave energy back and forth between the two cavities 70, 72. The bottom plate 80 may also form a mounting bracket 82 for affixing the microwave energy applicator 68 to the movable print carriage of the printer.

Figure 4A:
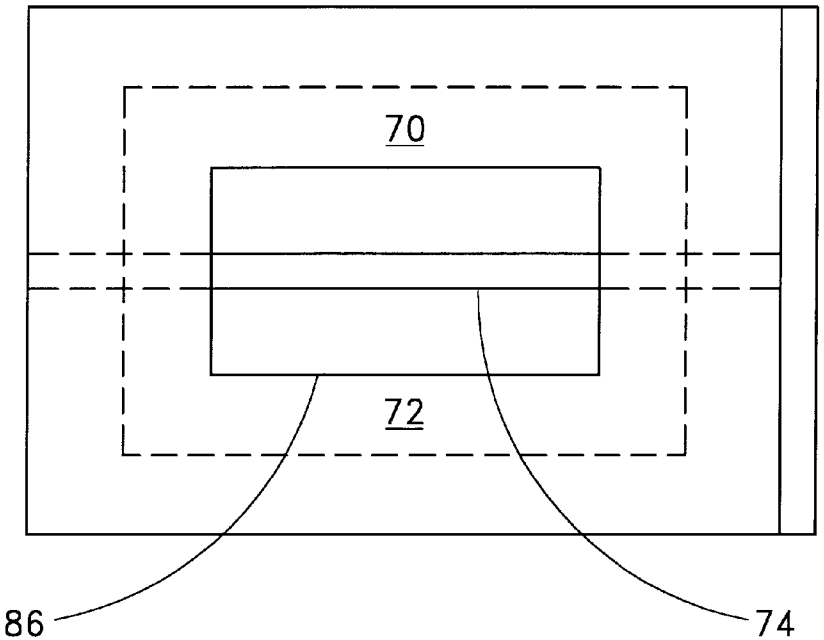
FIGS. 4A–4B are plan views of different dual slot configurations of microwave applicators.
Figure 4B:
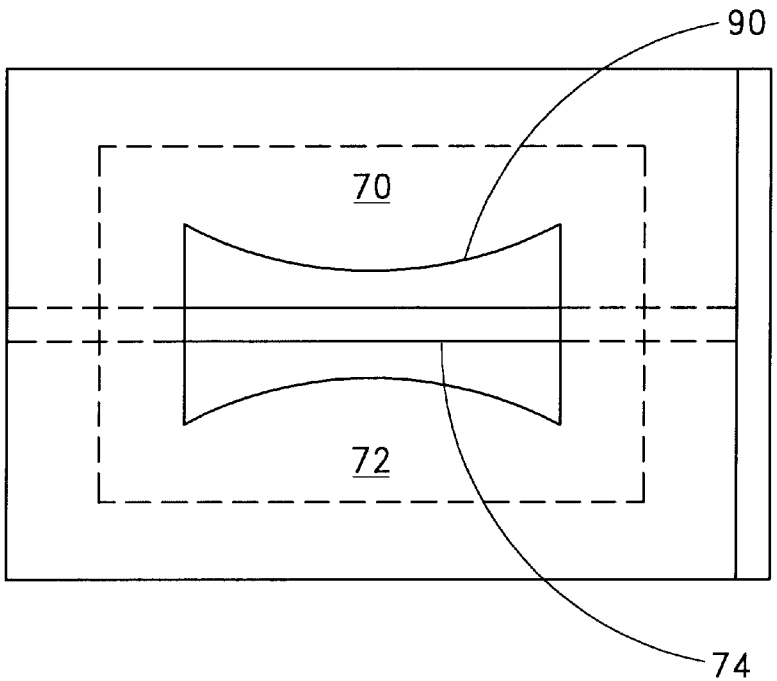

FIGS. 4A and 4B illustrate the bottom surface of the applicator 68 and show two embodiments of a slot antenna configuration of the microwave energy applicator 68. In FIG. 4A, a rectangular opening 86 in the bottom plate is approximately bisected by the central plate 74. In FIG. 4B, a "butterfly" shaped opening 90 is approximately bisected by the central plate 74. In each of these embodiments, a dual slot configuration is formed, with one half of the opening 86, 90 being coupled to the wave launching cavity 70 and the other half of the opening 86, 90 being coupled to the impedance matching cavity 72 and being separated from one another by the central plate 74.

Although the slot antenna design described above has been found to be especially advantageous, other microwave antenna shapes can also be used. Examples of such other shapes are circular antenna, cross antenna and horn antenna. Many others are known to those of ordinary skill in the art and can be used in this application.

Figure 5:
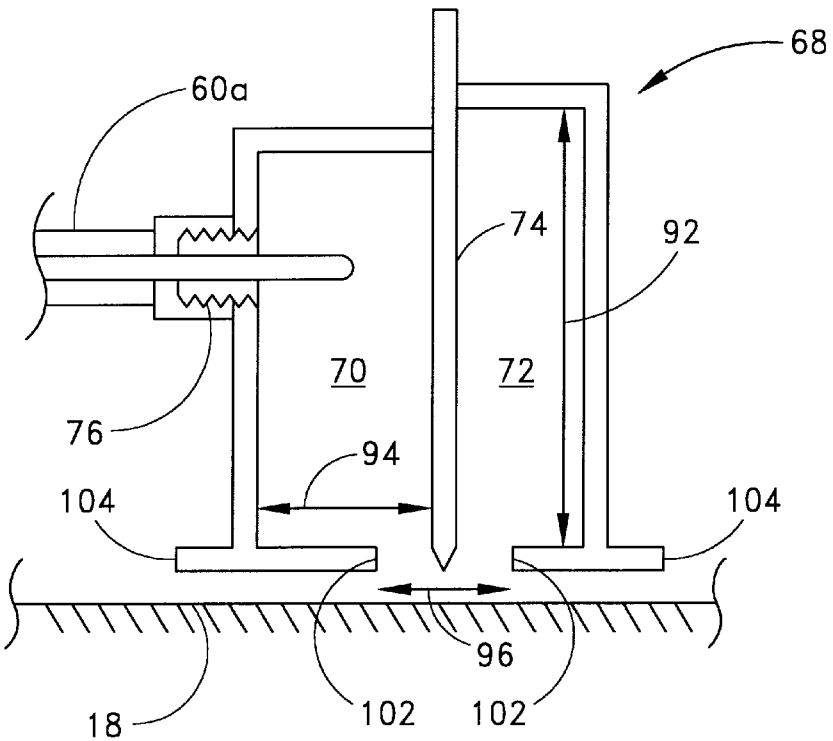
FIG. 5 is a cross sectional view of a microwave applicator suitable for mounting on the print carriage of FIG. 2.

FIG. 5 illustrates a cross section along lines 5—5 of FIGS. 3 of one embodiment of microwave applicator 68, showing the central plate 74 which separates the wave launching cavity 70 from the impedance matching cavity 72. The central plate 74 is advantageously tapered at its lower end. As described above, the wave launching cavity includes a coupler 76 for receiving a coaxial cable 60*a* driven by the microwave energy source (not shown). In the applicator 68 orientation illustrated in this Figure, the print carriage moves back and forth into and out of the plane of FIG. 5, depositing a swath of ink which is parallel to the length of the dual slot 86 in the bottom surface of the applicator 68. It will be appreciated, however, that the applicator could be configured to move in any desired direction over the media surface. In particular, the parallel slots can be oriented at an angle with respect to the direction of printer travel, to cover a print surface width that can be as wide as the slot length.

Preferably the dimensions of the cavities are as follows. The wave launching cavity 70 advantageously has an inside cross section approximately that of WR284 waveguide with a broad dimension of about $\frac{3}{5}\lambda$ and a small dimension 94 of about $\frac{1}{4}\lambda$, where $\lambda$ is the wavelength emitted by the center frequency of the microwave energy source, which is approximately 4.75 inches for 2.45 GHz microwaves. Thus, in one embodiment, the wave launching cavity has an inside rectangular (horizontal) cross section of about 2.84 inches by 1.34 inches. The dimensions of the wave launching cavity and the positioning of the coupler 76 are determined by well known microwave principles of wave launching.

The cross section of the impedance matching cavity 72 may be approximately the same as the wave launching cavity 70. The height of the impedance matching cavity is preferably an odd multiple of $\frac{1}{4}\lambda$. In particular, the height 92 can be approximately $\frac{3}{4}\lambda$.

The combined width 96 of the dual slot is advantageously slightly greater than the width of a swath of being printed, so that all of the ink deposited in a swath is approximately centrally located beneath the slots. In one embodiment, the length of the slots is about 3 inches, and the width 96 of the dual slot is about ½ inches.

The edges 102 of the rectangular opening 86 in the bottom plate 80 are preferably about $\frac{1}{4}\lambda$ from the outer edges 104 of the bottom plate 80. With these dimensions, the space between the bottom plate 80 and the electrically conductive platen 18 acts as a choke to confine the microwaves to that region. Additional protection from microwave leakage may be obtained by covering the outer surfaces of the applicator with a microwave absorbing material such as Ecosorb FGM-125 which is available from GAE engineering of Modesto, Calif. Using a Holaday microwave detector, the leakage for the system was under 1 mw/cm$^2$ at 2.45 GHz at a distance of 2 feet from the applicator mounted on the movable print carriage. Radio frequency leakage management can be achieved with this design and variations of the design suitable for a wide range of ink jet printer applications including desk top sized ink jet printers.

With the above described dimensions, absorption of microwave energy by the ink is maximized. This is because a substantially constant amplitude microwave frequency electric field is produced with a high intensity in the region near the dual slot and a low intensity external to the microwave applicator body and bottom plate.

Figure 6:
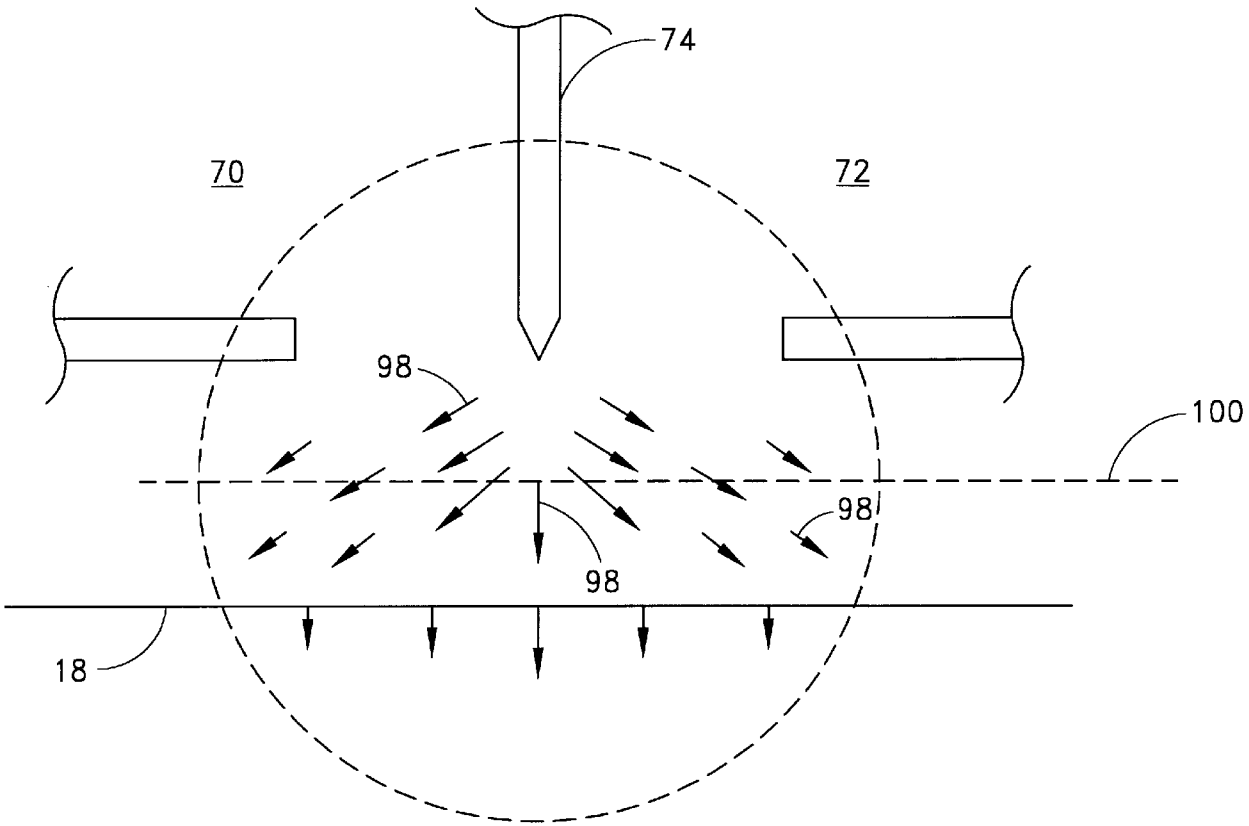
FIG. 6 is a cross sectional view of a microwave applicator positioned proximate to a substantially conductive printer platen.

The general configuration of these electric fields is shown in FIG. 6. This Figure is a close up of the dual slot 86 in the cross section of FIG. 5. Electric field strengths at various locations in the dual slot region are illustrated by arrows 98, where a longer arrow 98 indicates a larger electric field strength and the arrow 98 direction indicates the electric field direction. The electric field intensity is strongest in the region near and beneath the central plate, and is oriented substantially vertically in this region. Away from the center, the intensity drops off, and the electric field intensity has a larger horizontal component. The electric field becomes more vertically oriented closer to the platen surface of the substantially conductive platen 18. It is preferable to have the bottom plate 80 separated from the electrically conductive platen 18 by a distance of about 0.2 inches.

During operation of the applicator, microwave radiation exits the first slot shown in the wave launching cavity 70, penetrates the printed media, and then is guided by the boundaries between the bottom plate 80 and the electrically conducting platen 18 and absorbed a second time in the print media before going through the slot in the bottom of the impedance matching cavity 72. The waves are then reflected from the top electrically conductive plate of the impedance matching cavity 72 and then are radiated by the second slot to pass through the printed media a third time. Once again, the wave is guided by the boundaries between the bottom plate 80 and the electrically conducting platen 18 and go through the printed media a fourth time while being absorbed by the slot in the wave launching cavity. A fraction of the power reabsorbed in the wave launching cavity is then reflected again to make another multiple set of penetrations through the media.

With proper tuning, close to 100 percent of the power can be absorbed in the thin layers of ink typical of ink jet printed media, irrespective of the coverage. If the coverage is heavy, then only two or three passes of the microwave energy through the media could absorb all the power. If the coverage is light, then more than two or three passes of the microwave energy through the media would occur, and substantially all the power would still be absorbed.

It has been found that the effectiveness of energy transfer to the ink is improved when the media is exposed to electric fields having large horizontal components parallel to the plane of the media. Thus, it is not advantageous to have the media in contact with the surface of the platen 18 where the fields, though strong, are oriented substantially vertically. Rather, it has been found advantageous to position the media during printing approximately centrally between the platen 18 and the bottom of the applicator. This position is illustrated in FIG. 6 by dashed line 100. At this position, the media is exposed to electric fields having significant components parallel to the plane of the media, producing enhanced microwave energy absorption and ink drying. The electric field strength at the surface of the media ranges from $3\times10^4$ volts/meter to $3\times10^6$ volts/meter, with applied power of between 50 watts and 600 watts.

The weight of the microwave applicator as described above is less than 1 pound when the microwave energy source is mounted in one of the end housings. When the microwave energy source is mounted proximate to the applicator the total weight of applicator plus microwave energy source is less than 3 pounds when a magnetron energy source is used. When a solid state microwave energy source is used, the total weight of applicator plus microwave energy source can be less than 1.5 pounds. Low weight is beneficial to the process of moving the microwave applicator with the print carriage.

It is also possible to utilize center microwave frequencies other than 2.45 Ghz. Although 2.45 GHz is convenient because it is in an allowed industrial use frequency band and magnetrons designed for this frequency are widely and inexpensively available, there is another allowed band between 921 and 929 MHz which could be used. This wavelength would increase the above dimensions by a factor of a little more than 2. Higher frequencies such as 5.8 GHz, 24.125 GHz, 61.25 GHz, 122.5 GHz, and 245 GJZ may also be used, and would be advantageous because the size of the of the applicator would be decreased and the efficiency of energy absorption by the ink would be increased. For example, at 24.125 Ghz the dimensions of the moveable microwave applicator would be more than 10 times smaller than the microwave applicator in the above discussion. This would make the whole applicator about the width of one ink jet print swath. It would also decrease the weight to about 2 ounces. Microwave absorption in ink and other substances is proportional to the frequency of the microwaves. Thus, per unit volume of material, a 24.125 GHz source would be more than 10 times as efficient as a 2.45 GHz source. Smaller applicators would be desirable for use in desk top sized ink jet printers.

Figure 7A:
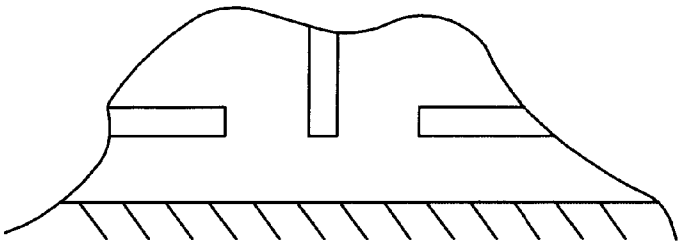
FIGS. 7A–7C are cross sectional views of different dual slot configurations of microwave applicators.
Figure 7B:
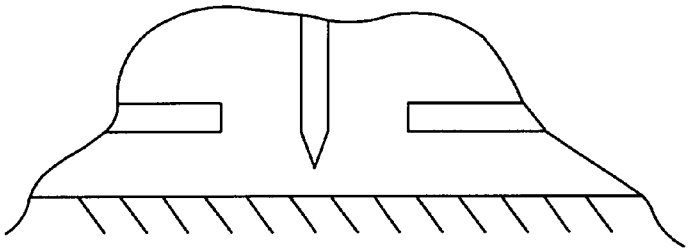
Figure 7C:
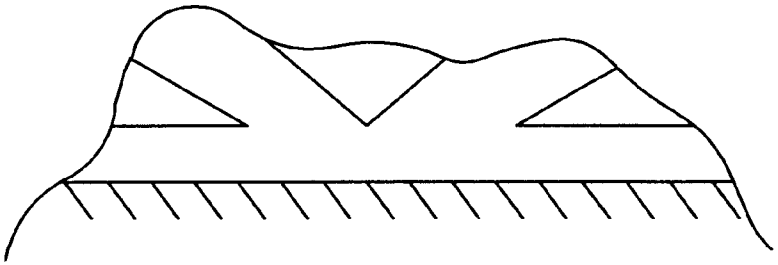

As illustrated in FIGS. 7A–7C, a variety of dual slot configurations may be used to produce electric fields of the general character illustrated in FIG. 6. For example, and as illustrated in FIG. 7A, the central plate 74 may have a flat bottom edge, rather than being tapered. Alternatively, and as illustrated in FIG. 7B, the central plate 74 may extend downward through the dual slot beneath the bottom plate of the applicator 68. In another embodiment, illustrated in FIG. 7C, the plate 74 is configured as a wedge. In this embodiment, the bottom plates of the cavities 70, 72 may be tapered to follow the wedge shape of the central plate 74, or they may be flat plates as shown in FIGS. 7A and 7B.

Figure 8:
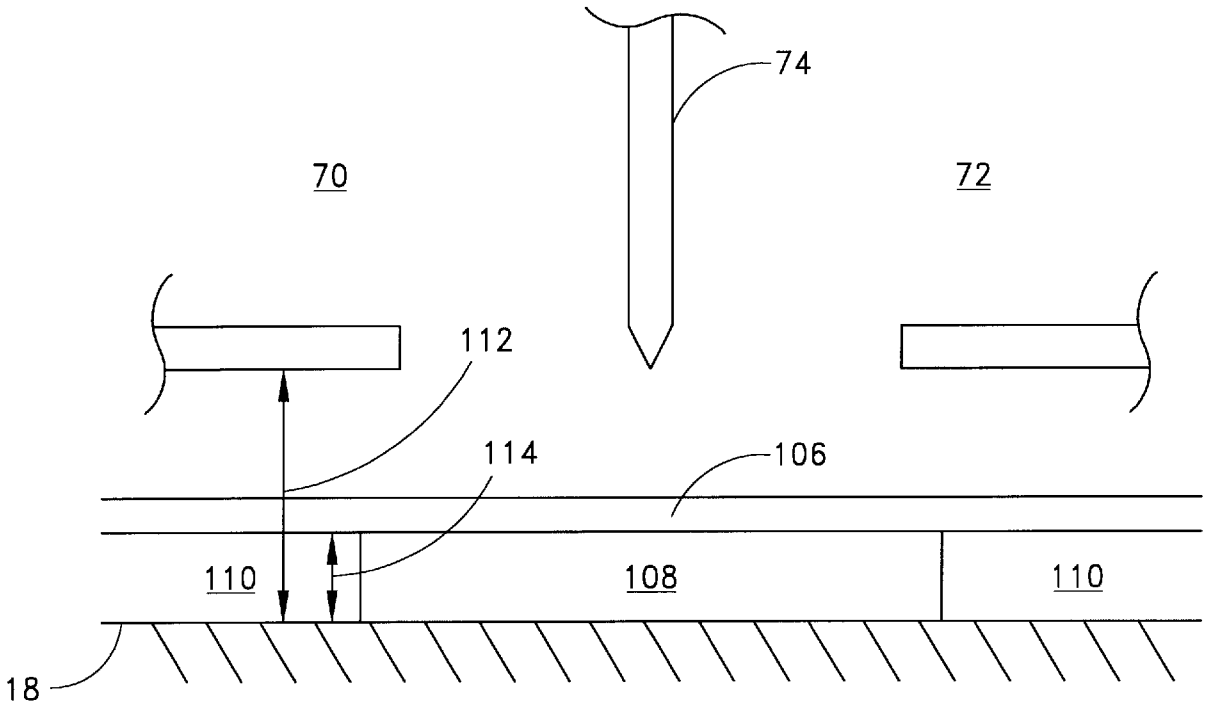
FIG. 8 is a cross sectional view of a microwave applicator positioned proximate to a substantially conductive printer platen.

FIG. 8 shows a cross section of a microwave applicator in proximity to a platen 18, and also shows a sheet of media 106 beneath the applicator 68. In this embodiment, the media 106 is supported above the platen 18 surface by a layer of material which covers the platen 18. This layer of material maintains the media in the region of electric fields containing relatively strong horizontal components as discussed above with reference to FIG. 6. Preferably, the layer comprises three different types of material. In the area 108 beneath and just beyond the dual slot, the material comprises a dielectric polymer material that is substantially transparent to the microwave energy. Many common plastics such as PTFE, glass reinforced nylon, or others are suitable. In the regions 110 outside the dual slot area, the material comprises a microwave absorbing material such as Ecosorb FGM-125 which is available from GAE engineering of Modesto Calif. The presence of microwave absorbing material on the periphery of the dual slot further reduces microwave leakage beyond the perimeter of the applicator 68, and also heats the media prior to printing the next swath, and after printing the last swath, which can further improve ink drying characteristics of the system. In one embodiment, the distance 112 between the platen 18 and the bottom of the applicator 68 is approximately 0.2 inches, and the thickness 114 of the layer is approximately 0.1 inches.

Figure 9:
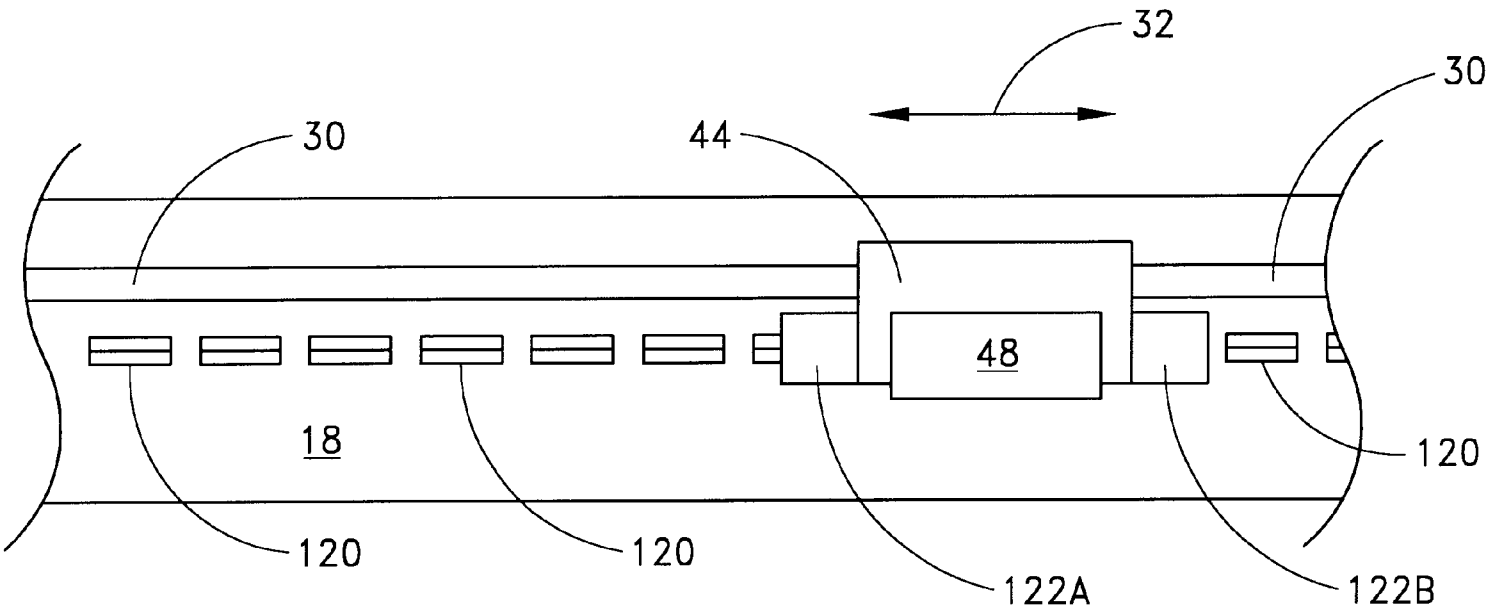
FIG. 9 is a top view of another printer embodiment having a platen incorporating a series of stationary microwave slot antennas.

Another alternative embodiment of the invention is illustrated in FIG. 9. In this embodiment, microwave applicators are stationary, rather than being affixed to the movable print carriage. FIG. 9 shows a top view of a platen 18 having a series of dual slots 120 formed therein. Each dual slot 120 is coupled to a wave launching and impedance matching cavity as described above but mounted beneath the platen 18. Thus, a series of microwave applicators extend along the platen beneath the printed swaths of ink.

In this embodiment, the carriage 44 is provided with two substantially conductive plates, 122A, 122B extending from each side. These metal plates 122A, 122B are positioned just above the platen 18 surface. As the carriage moves leftward in FIG. 9, for example, the ink applicator 48 deposits a swath of ink. As the trailing plate 122B passes over each dual slot, the corresponding microwave applicator is activated, thereby drying the ink between that dual slot and the plate 122B. Ink deposition and drying in the rightward direction proceeds in an analogous fashion, but the trailing plate is now plate 122A.

The above described microwave ink drying apparatus and methods provide many advantages over previously known systems. Wasted energy due to reflections back to the source are minimized. Furthermore, all the ink is exposed to substantially the same intensity of electric fields, making the drying process more even. Until the present invention, realization of uniformity of heating or drying with microwave applicators with intense electric field regions has been impractical because of the difficulty in arranging such intense electric field region applicators in a uniform manner over the printed media or web. Moving the microwave applicator with the ink jet print head eliminates the geometrical non-uniformity issue. The print surface is always exposed to substantially the same electric fields during drying. In addition, drying occurs as the ink is deposited, rather than after the image is complete, thereby improving the effectiveness of multi-pass printing techniques.

In some embodiments, reflected power can be measured, and and microwave power can be dynamically adjusted to compensate for variations in deposited ink density, further improving the consistency of ink drying across the entire image. In these embodiments, microwave power can be adjusted on time scales of microseconds. Thus, a sensor located in the tuner can sense the signal reflected from the applicator and adjust the power level depending on the ink coverage. For example, if no ink is being deposited the power can be kept at low level. Alternatively, the signals being used to control the ink jet printing process could be used to control the amount of microwave power being applied. i.e. if the ink jets are instructed to print at 100% coverage the signal can also maintain the microwaves at the appropriate power. In other words, microwave power can be controlled and synchronized with the ink-media system to modulate the cure process. This is useful for color management and to minimize banding.

EXAMPLE 1

Single Slot Applicator

Using a single slot applicator with slot dimensions of 3 inches by 0.18 inch, the temperature rise rate of water soaked paper placed proximate to the slot was measured using a Cole-Parmer infrared thermal probe. At a net microwave power of 60 watts, the temperature rise was 198° C. in a time period of between one and two seconds. This is a heating rate of 1.6° C./second-watt. In 2 seconds, the paper was observed to char.

In comparison, in U.S. Pat. No. 5,220,346 awarded to Carreira, L., the temperature rise in a rectangular microwave applicator (with the ink in a test tube) was 29° C. in 5 seconds at 330 watts. This is a heating rate of only 0.017° C./second-watt.

EXAMPLE 2

Dual Slot Applicator

A dual slot applicator 68 as described above was used to dry ENCAD 600 dpi GO-Cyan printed on plain paper with 100% coverage with an ink jet printer. The bottom plate 80 comprised 2 parallel slots, each about 3 inches long and ⅛ inch in width, separated by about ⅛". A styrofoam layer about ⅛" thick was placed on the electrically conducting platen 18 and the bottom plate 80 was located 0.04 inches above the printed paper. The total separation between the bottom plate 80 and the electrically conducting platen was about 0.2 inches.

With a net power of about 150 watts applied by the microwave applicator 68 the ink dried almost immediately. If microwave application was continued, the paper actually reached a charring state within about 2 seconds. The ink under both slot areas was dried completely.

EXAMPLE 3

Dye Sublimation

Inks which sublimate when heated can be printed on textiles. Typically, they are printed and then passed through an infrared oven or hot air dryer where the temperature is raised to about 400° F., whereupon the dye is sublimated and is fixed to the textile.

Sublijet blue dye sublimation ink from Sawgrass Corporation, was printed on a white polyester using an ink jet printer and was exposed to a dual slot microwave energy from applicator for a period of 2 seconds at 200 watts. The textile was subsequently washed. The result was that each of the two slots had fixed the dye along the entire length of the slot.

EXAMPLE 4

Driving Ink on Non-porous and Uncoated Vinyl

Drying ink jet printed ink on non-porous and uncoated vinyl sheet is desirable, but difficult because the ink can form beads and move on the surface. Immediate drying with microwaves can stop the movement of the ink and dry it on an untreated vinyl surface.

ENCAD experimental GO-magenta ink was printed on untreated sheet vinyl and exposed to the microwave energy from a dual slot microwave energy applicator. With exposure at 200 watts for 4 seconds the ink adhered.

Thus the invention is shown to solve two of the major problems associated with drying of ink on print media. First, uniformity of electric field geometry is provided by moving the applicator over the surface. Second, multiple passes of the microwaves through the media can lead to an absorption efficiency close to 100 percent for all levels of ink coverage whether the coverage is light or heavy. Finally, the power level can be adjusted to match the ink loading.

Some ink jet printers, such as desk top ink jet printers, do not have an electrically conductive platen. For example, in some cases the paper is supported by thin plastic supports while the printer carriage moves across the paper. In other words, there is a space consisting only of air under the media. Alternatively, the space could be filled with a ceramic or dielectric material. The moving microwave energy applicator concept of this invention can be adapted to this situation. The electric field patterns near the slot antenna would still be intense. Removal of the electrically conducting platen 18 in FIG. 6 would not influence the directions and magnitude of the electric fields near the print media surface when the print media surface is proximate to the print media. With proper impedance matching, the multiple passes of microwave energy through the media would also take place. An electrically conductive surface may be included to help prevent microwave leakage and could be incorporated in the box containing the printer.

This invention has a wide variety of benefits and applications. As described in detail above, the drying of ink jet ink deposited on a paper media is one useful application. The sharpness of individual ink dots can be maintained by preventing spreading of the dot in the media. Coalescence of adjacent dots can be prevented by drying before they coalesce. Microwave drying between passes can be used to dry or partially dry one ensemble of dots before a second ensemble is applied, minimizing coalescence of the second set of dots with the first set. The shape of individual dots can be maintained by drying them before their shape can be changed by contact with other dots or by wetting the fibers of the media. Most importantly the speed of drying and the quality of printing multiple passes can be greatly improved.

The aqueous liquid vehicle in thermal ink jet printing can create quality problems if not substantially removed from the media. For example, if the sheet is covered with more than 50% printing, and the liquid is not removed quickly, then defects in the image, such as strike through, and paper deformation such as cockle can result. The present invention can minimize such problems by removing the liquid essentially immediately after printing. Use of this invention can permit use of inexpensive printing paper, because special coatings will not be needed to provide absorption of the liquid in the ink.

Substrates such as uncoated vinyl can be printed on with an ink jet printer without regard to surface tension.

There are also applications of the invention in other fields of use than ink jet printing. For example, the electric field intensity in the slots could be raised to produce a controlled electrical breakdown plasma in the air directly over the surface of the vinyl to produce plasma activation of the surface molecules. Such surface modifications could improve the adhesion of ink on the vinyl surface. Another application of such a continuous breakdown source would be to sterilize surfaces of materials. The microwave applicator could be mounted on a moveable assembly and moved in a computer controlled system across say, a wooden surface and woodburning or texturing of the surface could be accomplished with microwave heating. The properties of laminated ink jet product can also be improved with this invention. For example, by removing substantially all the liquid from the ink and media prior to lamination, one can increase the UV resistance and color stability versus time. Other ink jet products could also be envisioned. For example, the field of stereolithography could benefit from this invention. Ink jet solid imaging, in which a printer similar to an ink jet printer moves around a platform and, by projecting microdots of plastic to produce solid objects, could also benefit by an instant solidification via a microwave applicator that travels with the ink jet printer. In these embodiments, an ink jet printer could make toys or other useful objects by downloading patterns from the internet.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A method of drying ink during or after an ink jet printing process, said method comprising:

passing a microwave energy applicator connected to a microwave energy source over deposited ink droplets on a print media;

directing microwave energy from a first cavity comprising a wave launching cavity in said microwave energy applicator through a first portion of an opening in said applicator so as to heat said deposited ink droplets; and directing the microwave energy with a platen towards a second cavity in said microwave energy applicator through a second portion of an opening in said applicator, wherein said second cavity comprises an impedance matching cavity with a height that is substantially an odd multiple of ¼ of the wavelength emitted by a center frequency of the microwave energy source.

2. The method of claim 1, wherein said passing is performed at the same rate as the motion of a print carriage.

3. A method of drying ink during or after an ink jet printing process, said method comprising:

passing a microwave energy applicator over deposited ink droplets on a print media, wherein said passing is performed within approximately five seconds after depositing said ink droplets;

directing microwave energy from a first cavity in said microwave energy applicator through a first portion of an opening in said applicator so as to heat said deposited ink droplets; and directing the microwave energy towards a second cavity in said microwave energy applicator through a second portion of an opening in said applicator.

4. The method of claim 3, wherein said passing is performed within approximately 0.1 seconds after depositing said deposited ink droplets.

5. A method of ink jet printing comprising:

depositing a swath of ink droplets using a plurality of sequential passes of at least one ink jet print head;

drying ink droplets deposited during at least one of said sequential passes with microwave radiation from an applicator by directing said microwave radiation through a slot antenna so that it passes through said ink droplets a first time, then directing said microwave radiation with a platen so that at least some of the microwave energy passes through said ink droplets a second time and is received back in the applicator, wherein said act of drying is performed prior to performing a subsequent pass of said sequential passes.

6. The method of claim 5, wherein said drying is performed by passing a microwave energy applicator over deposited ink droplets during each pass of said sequential passes.

7. A method of ink jet printing comprising:

depositing a swath of ink droplets using a plurality of sequential passes of at least one ink jet print head;

drying ink droplets deposited during at least one of said sequential passes with microwave radiation prior to performing a subsequent pass of said sequential passes, wherein said drying is performed by passing metal plates attached to the print carriage over dual slot radiators embedded in the platen.

8. The method of claim 7, wherein said dual slot radiators are turned on in sequence and dry the ink as the metal plate is passed over them.

* * * * *